United States Patent [19]

Makimoto et al.

[11] 4,437,076

[45] Mar. 13, 1984

[54] COAXIAL FILTER HAVING A PLURALITY OF RESONATORS EACH HAVING A BOTTOMED CYLINDER

[75] Inventors: Mitsuo Makimoto, Yokohama; Haruyoshi Endo, Sagamihara; Ko Kikuchi, Tokyo; Sadahiko Yamashita, Sagamihara, all of Japan

[73] Assignee: Matsushita Electric Industrial Co., Ltd., Osaka, Japan

[21] Appl. No.: 348,766

[22] Filed: Feb. 16, 1982

[30] Foreign Application Priority Data

Feb. 17, 1981 [JP] Japan ..... 56-22602

[51] Int. Cl.[3] ..... H01P 1/205; H01P 7/05

[52] U.S. Cl. ..... 333/206; 333/222; 333/245

[58] Field of Search ..... 333/202, 206, 207, 219, 333/222, 223, 224, 245

[56] References Cited

U.S. PATENT DOCUMENTS 4,268,809 5/1981 Makimoto et al. ..... 333/202

4,292,610 9/1981 Makimoto et al. ..... 333/207 X

*Primary Examiner*—Marvin L. Nussbaum

*Attorney, Agent, or Firm*—Lowe, King, Price & Becker

[57] ABSTRACT

In a coaxial filter arrangement having a plurality of coaxial resonators each having a bottomed metallic cylinder interposed between a dielectric plate and one end of a center conductor of each resonator, the peripheral wall portion of the metallic cylinder is received in the bore of an outer conductor having an open end and a closed end connected to the other end of the center conductor. In one embodiment, the bottom of the metallic cylinder has a convex portion at its center so that the bottom center projects outwardly. In another embodiment, an annular metallic member is interposed between the dielectric plate and the outer surface of the flat bottom of the metallic cylinder. Since the distance between bottoms of metallic cylinders of adjacent resonators is made large with this arrangement, influence due to leakage flux of electromagnetic field is small, while stray capacitance is negligibly small, thereby providing a filter having high performance and low loss.

12 Claims, 13 Drawing Figures

COAXIAL FILTER HAVING A PLURALITY OF RESONATORS EACH HAVING A BOTTOMED CYLINDER

BACKGROUND OF THE INVENTION

This invention relates generally to filters used for UHF (ultrahigh frequency) and/or SHF (superhigh frequency) band, and more particularly, the present invention relates to coaxial filters which comprise a plurality of coaxial resonators.

Since coaxial resonators, which are small in size and have a high value of unloaded Q, can be readily designed, they have been used as the resonators of oscillators, filters or the like in UHF and SHF bands for a long time. Meanwhile, the performance of semiconductor elements has been remarkably improved, and accordingly, various active elements have been made in the form of solid-state elements. As various elements are made of solid-state elements, demands for providing smaller devices have been increased. As a result, it is now required to provide smaller oscillators, filters or the like which are suitable for such small devices. For this reason, it is a technical problem in these days to provide a small resonator which constitute such circuits.

When reducing the size of a resonator, attention has to be given so that unloaded Q value is not deteriorated because coaxial resonators is apt to suffer from deterioration in unloaded Q value, increasing loss when the size thereof is simply reduced.

The inventors of the present invention devised a coaxial resonator having new structure so that the size thereof is small and the value of Q is high, and proposed this new coaxial resonator in Japanse Patent Provisional publication No. 55-100701. This resonator comprises a bottomed metallic cylinder attached to one end of the center conductor received in a bore of an outer conductor. Although this new coaxial resonator is more superior than the conventional coaxial resonators when the resonator is used alone, the inventors have realized that the coaxial resonator is not suitable for constituting a filter because the value of Q lowers when a plurality of such coaxial resonators are combined and built in a casing. Therefore, when a filter is constructed of a plurality of such resonators, the value of Q of the entire filter is very low.

SUMMARY OF THE INVENTION

This invention has been achieved in order to remove the above-mentioned drawback or disadvantage inherent to the known coaxial filters having a plurality of coaxial resonators.

It is, therefore, an object of the present invention to provide a VHF-UHF filter having coaxial resonators, which exhibits a high value of Q, while the size of the filter is small.

According to the present invention, an improvment has been made in connection with the shape of the bottomed metallic cylinder of each resonator so that there is a sufficient space between bottomed metallic cylinders of adjacent resonators.

In accordance with the present invention there is provided a coaxial filter arrangement comprising: a plurality of resonators each having; a center conductor; a metallic cylinder having a bottom and a peripheral wall portion with a predetermined diameter, said metallic cylinder being attached to one end of said center conductor in such a manner that said peripheral wall portion surrounds said center conductor; and an outer conductor having a closed end and an open end, said closed end being connected to the other end of said center conductor so that said outer conductor is coaxially arranged with said center conductor, the axial length of said outer conductor being shorter than that of said center conductor so that said peripheral wall portion of said metallic cylinder is received in the bore of said outer conductor; and a dielectric plate having coupling capacitances for coupling said plurality of resonators to form said filter, said dielectric plate being positioned apart from the open end of each of said outer conductors by a predetermined distance.

BRIEF DESCRIPTION OF THE DRAWINGS

The object and features of the present invention will become more readily apparent from the following detailed description of the preferred embodiments taken in conjunction with the accompanying drawings in which.

The same or corresponding elements and parts are designated at like numerals throughout the drawings.

DETAILED DESCRIPTION OF THE INVENTION

Prior to describing preferred embodiments of the present invention, the above-mentioned known or conventional coaxial resonator, which has been deivised prior to the present invention, will be described for a better understanding of the features of the present invention.

Figure 1A:
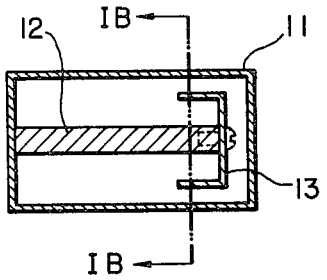
FIG. 1A PRIOR ART
FIGS. 1A and 1B are respectively cross-sectional front view and cross-sectional top plan view taken along the line IB—IB of FIG. 1A, of a conventional coaxial resonator which is small and has a high value of Q.
Figure 1B:
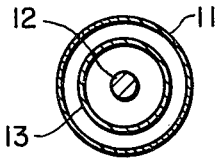
FIG. 1B PRIOR ART
Figure 2A:
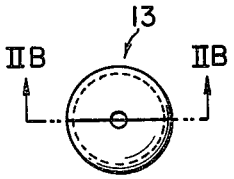
FIG. 2A PRIOR ART
FIGS. 2A and 2B are respectively a top plan view and a cross-sectional front view taken along the line IIB—IIB of FIG. 2A, of the metallic cylinder attached to one end of the center conductor of the coaxial resonator of FIGS. 1A and 1B.
Figure 2B:
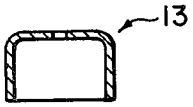
FIG. 2B PRIOR ART

FIGS. 1A and 1B show the conventional coaxial resonator which is disclosed in the aforementioned Japanese Patent Provisional Publication. The coaxial resonator comprises an outer conductor 11, which functions as a casing, a center conductor 12, and a bottomed cylinder 13 made of a metal. The bottomed cylinder 13 is attached to one end or tip portion of the center conductor 12 so that the bottomed cylinder 13 is coaxial with the center conductor 12 and the center conductor 12 is partially surrounded by the peripheral wall portion of the bottomed cylinder 13. The bottomed cylinder 13 has a structure as shown in FIGS. 2A and 2B. Namely, a center hole (no numeral) is made at the center of the bottom portion of the bottomed cylinder 13, and thus the bottomed cylinder 13 is attached by means of a screw (no numeral) to one end of the center conductor 12 as shown in FIG. 1A.

Figure 3A:
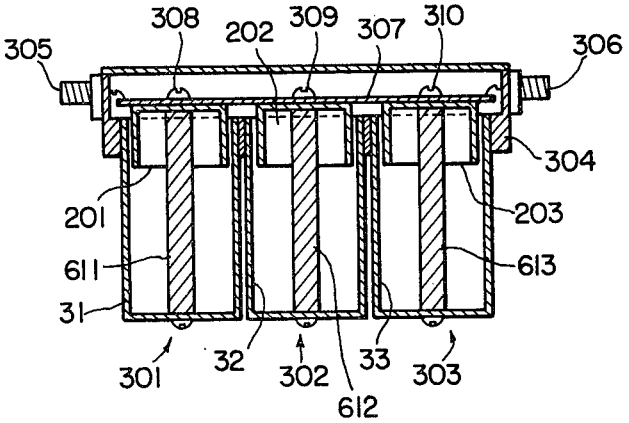
FIG. 3A PRIOR ART
FIGS. 3A and 3B are respectively a cross-sectional front view and a top plan view of the conventional band-pass filter having a plurality of the coaxial resonators of FIGS. 1A and 1B, where the top plan view of FIG. 3B is viewed with the top plate of the filter being taken away.
Figure 3B:
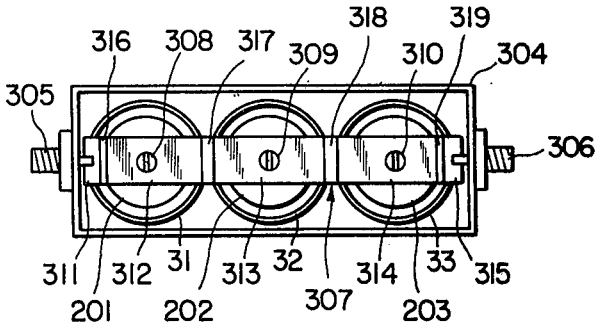
FIG. 3B PRIOR ART

Since the resonator having the above-described structure is symmetry with respect to its axis, i.e. the longitudinal axis of the center conductor, the distribution of electromagnetic field is also symmetrical with respect to the axis so as to be uniform. Therefore, a higher Q can be obtained compared to ordinary resonator having a lumped constant capacitance at its tip portion, with the same sized resonator. When a plurality of such resonators are used to constitute a band-pass filter as shown in FIGS. 3A and 3B, however, it has become clear that the band-pass filter arranged in this way has various problems as will be described hereinbelow. In the following analysis of the operation of the band-pass filter of FIGS. 3A and 3B, it is to be noted that the metallic cylinder 13 attached to the center conductor 12 of each resonator has a substantially flat bottom.

FIGS. 3A and 3B illustrate a three-stage band-pass filter. The reference numerals 301 to 303 are resonators each having the same structure as the resonator of FIGS. 1A and 1B; 304, a casing for supporting the resonators 301 to 303; 305 and 306, input and output connectors; 307, a dielectric plate in which coupling capacitances are formed; 308 to 310, screws for securing the dielectric plate 307 and metallic cylinders 201 to 203, which are provided at the tip portion of each resonator 301 to 303, to one end of each center conductor 601 to 603; 31 to 33, outer conductors of the resonators 301 to 303. One surface of the dielectric plate 307 is coated with a copper film or layer so that the dielectric plate 307 exhibits low loss. The copper film is divided into a plurality to provide a plurality of conductor patterns functioning as electrodes 311 to 315. Input coupling capacitance is formed by using the gap capacitor at a gap 316 between the electrods 311 and 312, while output coupling capacitance is formed by using the capacitor at a gap 319 between the electrods 314 and 315. In the same manner, interstage coupling capacitances are formed by using the gap capacitors at the gaps 317 and 318 which are positioned respectively between the electrodes 312 and 313 and between the electrodes 313 and 314.

Figure 4:
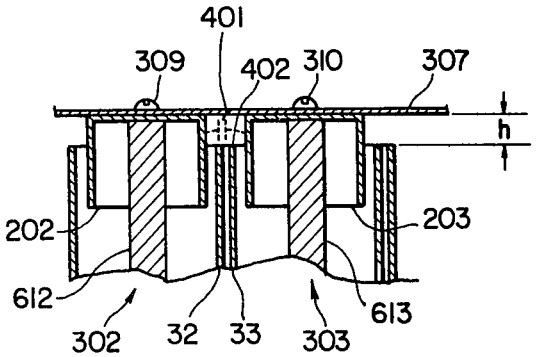
FIG. 4 PRIOR ART
FIG. 4 is an enlarged partial view of FIG. 3A.

The dielectric plate 307, which functions as a coupling substrate, in the above structure has to be apart from the ground conductor which corresponds to the outer conductors 31 to 33. For this reason, it is necessary that the center conductor of each coaxial resonator 301 to 303 be designed to have a length longer than the outer conductors 31 to 33 as best seen in FIG. 4 which is an enlarged partial view of FIG. 3A. Since each of the center conductors is longer than the longitudinal or axial length of each of the outer conductors 31 to 33, the electric field at the tip portion of each coaxial resonator 301 to 303 spreads out beyond its outer conductor 31 to 33. Namely, the electric flux from each resonator 301 to 303 leaks, and thus the value of Q is considerably deteriorated. In addition, the leakage electric flux from adjacent resonators couple together especially around the tip portion of the resonators.

The above-described phenomena of leakage electric flux will be further described in detail with reference to FIG. 4. The resonators 302 and 303 are coupled together via the coupling capacitor at the gap 318 (see FIG. 3B) which is formed in the dielectric plate 307. Therefore, the dielectric plate 307 has to be positioned apart from the open end portion 402 of the outer conductors 32 and 33 of the resonators 302 and 303 to prevent the value of capacitance from changing due to influence from the outer conductors 32 and 33. Consequently, it is necessary that a space "h" is made between the lower surface of the dielectric plate 307 and the open end portion 402 of the outer conductors 32 and 33. According to experiments, undesirable influence from the outer conductors 32 and 33 can be avoided when the space "h" is more than 1 millimeter. When the coupling section between two resonators is constructed in this way, each metallic cylinder 202 or 203 attached to the tip portion or upper end of each center conductor is positioned such that the bottom portion, i.e. the upper portion in the drawings, of each metallic cylinder 202 or 203 has to protrude beyond the open end portion 402 of the outer conductors 32 and 33. Because of this structure the electric field at the tip portion of each resonator spreads beyond the coaxial outer conductor 32 or 33 thereof. As a result, the value of Q of the entire band-pass filter is apt to be deteriorated. Furthermore, stray capacitance 401 is apt to occur between adjacent metallic cylinders 202 and 203, which stray capacitance may lower the attenuation characteristic of the band-pass filter.

Figure 5A:
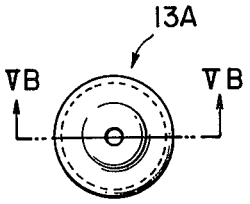
FIGS. 5A and 5B are respectively a top plan view and a cross-sectional front view taken along the line VB—VB of FIG. 5A, of the metallic cylinder attached to one end of the center conductor of the coaxial resonator which constitute the coaxial filter according to the present invention.
Figure 5B:
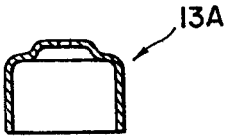

According to the present invention, an improvement has been made in connection with the shape of the metallic cylinder attached to one end of the center conductor of each resonator. FIGS. 5A and 5B show an example of a metallic cylinder which may be used for each resonator of the filter according to the present invention. As best seen in the cross-sectional view of FIG. 5B, the bottomed metallic cylinder, which is designated at the reference 13A, has a convex bottom. In detail, the bottom of the metallic cylinder 13A is outwardly projecting in the vicinity of the center. Such bottomed metallic cylinder 13A can be readily formed by means of a press.

Figure 6:
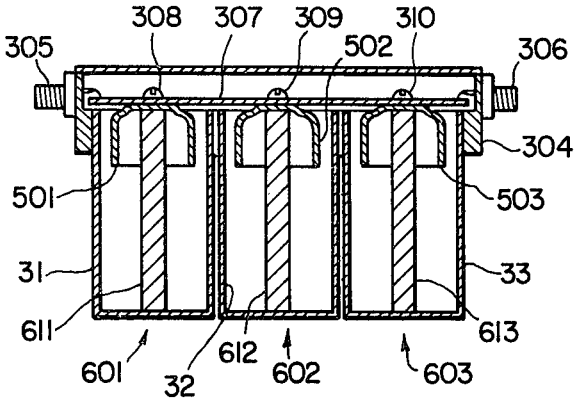
FIG. 6 is a cross-sectional front view of an embodiment of the coaxial filter according to the present invention.

FIG. 6 shows an embodiment of the filter according to the present invention, in which each metallic cylinder attached to the tip portion of the center conductor of each resonator has the structure as shown in FIGS. 5A and 5B. The filter of FIG. 6 is designed to function as a band-pass filter for UHF and/or SHF band, and has the same structure except for the metallic cylinders 501 to 503 which correspond to 13A of FIGS. 5A and 5B. The reference numerals 601 to 603 generally designate three resonators used in the band-pass filter; 304, a casing for supporting the resonators 601 to 603; 305 and 306, input and output connectors; 307, a dielectric plate in which coupling capacitances are formed; 308 to 310, screws for securing the dielectric plate 307 and the metallic cylinders 501 to 503, which are provided at the tip portion of each resonator 601 to 603, to one end of each center conductor 611 to 613; and 31 to 33, outer conductors of the resonators 601 to 603. Each of the outer conductors 31 to 33 has an open end and a closed end at its opposite ends. One surface of the dielectric plate 307 is coated with a copper film or layer so that the dielectric plate 307 exhibits low loss. The copper film is divided into a plurality to provide a plurality of conductor patterns functioning as electrodes 311 to 315. Input coupling capacitance is formed by using the gap capacitor at a gap 316 between the electrods 311 and 312, while output coupling capacitance is formed by using the capacitor at a gap 319 between the electrods 314 and 315. In the same manner, interstage coupling capacitances are formed by using the gap capacitors at the gaps 317 and 318 which are positioned respectively between the electrodes 312 and 313 and between the electrodes 313 and 314.

The other end of each center conductor 611, 612 or 613 is connected to the closed end of the outer conductor 31, 32 or 33 so that the center conductor is mostly received in the bore of the outer conductor 31 to 33. The dielectric plate 307, which functions as a coupling substrate, is spaced from open end 402 of the outer conductors 31 to 33 in the same manner as in the conventional example of FIG. 3A. The peripheral wall portion of each metallic cylinder 501, 502 or 503, having the maximum diameter is received in the bore of the corresponding center conductor 301, 302 or 303 in such a manner that the peripheral wall portion is located inside the bore, namely, below the open end portion 402 of the outer conductors 31 to 33 in FIG. 6. Accordingly, only the convex center bottom of each metallic cylinder 501, 502 or 503 projects beyond the open end portion 402 of the outer conductors 31 to 33.

Figure 7:
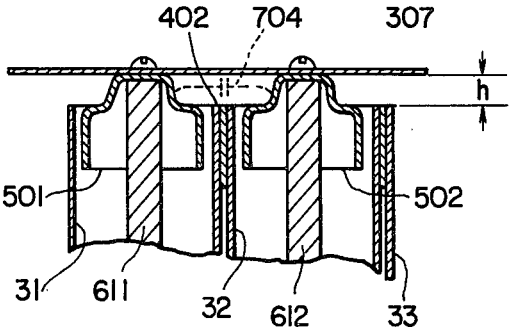
FIG. 7 is an enlarged partial view of FIG. 6.

FIG. 7 is an enlarged partial view of the band-pass filter of FIG. 6. As seen in this enlarged view, although the dielectric plate 307 is spaced from the open end portion 402 of the conductors 301 to 303 with a predetermined distance "h" in the same manner as in FIG. 4, the distance between the convex projections of the bottoms of the metallic cylinders 501 to 503 in much larger than that in FIG. 4. Since stray capacitances are formed between the convex projections of adjacent metallic cylinders 501 to 503, the value of each stray capacitance 704 is much smaller than that of the stray capsictance 401 of FIG. 4.

In addition since the distance between the convex projection of the metallic cylinder 501 to 503 and the open end portion 402 of the outer conductor 31 to 33 of each resonator 601 to 603 is also longer than that in FIG. 4, the intensity of the electric field in the vicinity of the tip portion of each resonator 601 to 603 is condiderably smaller than that in FIG. 4. As a result, disturbance in electric field is minimized.

From the above, it will be understood that the electromagnetic field of each resonator 601 to 603 is concentrated inside thereof, while stray capacitance which results in undesirable coupling is reduced. Therefore, it is possible to provide a filter having high performance and low loss.

Figure 8A:
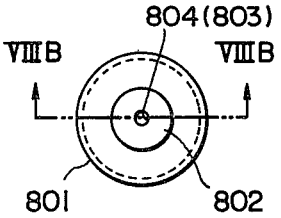
FIGS. 8A and 8B are respectively a top plan view and a cross-sectional front view taken along the line VIIIB—VIIIB of FIG. 8A, of the metallic cylinder attached to one end of the center conductor of the coaxial resonator which constitute a second embodiment coaxial filter according to the present invention.
Figure 8B:
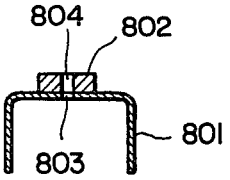

FIGS. 8A and 8B show another example of the metallic cylinder used for each resonator of the filter according to the present invention. As best seen in the cross-sectional view of FIG. 8B, the bottomed metallic cylinder 13A of FIGS. 5A and 5B is replaced with the combination of a bottomed metallic cylinder 801 having a flat bottom, and an annular metallic member 802. The annular metallic member or disk 802 has a diameter which is smaller than that of the outer diameter of the metallic cylinder 801. A center hole 803 is made in the center of the flat bottom of the metallic cylinder 801. The annular metallic member 802, which functions as a spacer, has a center hole 804 so that the annular metallic memer 802 is secured, by means of a screw, between the lower surface of the dielectric plate 307 (see FIG. 7) and the upper or outer surface of the flat bottom of the metallic cylinder 801. Namely, the annular metallic member 802 substantially corresponds to the convex projection of the metallic cylinder of FIGS. 5A and 5B. The thickness of the anuular metallic member 802 may be adjusted so as to provide a desired space between the diectric plate 307 and the open end portion 402 of the outer conductors 31 to 33 when a plurality of resonators each having the metallic cylinder 801 and the annular metallic member 802 are assembled to form a filter.

When the flat-bottomed cylinder 801 and the annular metallic member 802 are combined, the combination functions in the same manner as the metallic cylinder 13A having a convex bottom, and therefore, when a filter is constructed by using a plurality of resonators each having such combination, the filter operates in a similar manner as described in the above. Although the arrangement of FIGS. 8A and 8B requires the annular metallic member 802 in addition to the metallic cylinder 801, there is no need to machine the metallic cylinder so as to provide the convex projection at the bottom thereof.

From the foregoing, it will be understood that the present invention provides a filter having a plurality of resonators each having a metallic cylinder with convex projection or an annular metallic member attached thereto, thereby preventing leakage of electromagnetic field, deterioration in Q value, and reducing stray capacitances. As a result, it is possible to mass produce filters having high performance and low loss.

The above-described embodiments are just examples of the present invention, and therefore, it will be apparent for those skilled in the art that many modifications and variations may be made without departing from the spirit of the present invention.

What is claimed is:

1. A coaxial filter arrangement comprising:

(a) a plurality of resonators each having:

a center conductor;

a metallic cylinder having a bottom and a peripheral wall portion with a predetermined diameter, said metallic wall portion being attached to one end of said center conductor in such a manner that said peripheral wall portion surrounds said center conductor; and an outer conductor having a closed end and an open end, said closed end being connected to the other end of said center conductor so that said outer conductor is coaxially arranged with said center conductor, the axial length of said outer conductor being shorter than that of said center conductor so that said metallic cylinder is received in the bore of said outer conductor with a maximum diameter portion of said peripheral wall portion being received entirely in said bore; and (b) a dielectric plate having coupling capacitances for coupling said plurality of resonators to form said filter, said dielectric plate being positioned apart from the open end of each of said outer conductors by a predetermined distance.

2. A coaxial filter as claimed in claim 1, wherein the bottom of said said metallic cylinder is convex so that the center of said bottom projects outwardly.

3. A coaxial filter as claimed in claim 1, further comprising an annular metallic member interposed between said dielectric plate and the outer surface of said bottom of said metallic cylinder of each of said resonators.

4. A coaxial filter as claimed in claim 3, wherein the diameter of said annular metallic member is smaller than the outer diameter of said metallic cylinder.

5. A coaxial filter arrangement comprising:

(a) a plurality of resonators each having;

a center conductor;

a metallic cylinder having a bottom and a peripheral wall portion with a predetermined diameter, said metallic wall portion being attached to one end of said center conductor in such a manner that said pheripheral wall portion surrounds said center conductor, said bottom being convex so that the center of said bottom projects outwardly; and an outer conductor having a closed end and an open end, said closed end being connected to the other end of said center conductor so that said outer conductor is coaxially arranged with said center conductor, the axial length of said outer conductor being shorter than that of said center conductor so that said peripheral wall portion of said metallic cylinder is received in the bore of said outer conductor; and (b) a dielectric plate having coupling capacitances for coupling said plurality of resonators to form said filter, said dielectric plate being positioned apart from the open end of each of said outer conductors by a predetermined distance.

6. A coaxial filter arrangement comprising:

(a) a plurality of resonators each having;

a center conductor;

a metallic cylinder having a bottom and a peripheral wall portion with a predetermined diameter, said metallic wall portion being attached to one end of said center conductor in such a manner that said peripheral wall portion surrounds said center conductor; and an outer conductor having a closed end and an open end, said closed end being connected to the other end of said center conductor so that said outer conductor is coaxially arranged with said center conductor, the axial length of said outer conductor being shorter than that of said center conductor so that said peripheral wall portion of said metallic cylinder is received in the bore of said outer conductor;

(b) a dielectric plate having coupling capacitances for coupling said plurality of resonators to form said filter, said dielectric plate being positioned apart from the open end of each of said outer conductors by a predetermined distance; and (c) a plurality of annular metallic members each interposed between said dielectric plate and the outer surface of said bottom of said metallic cylinder of each of said resonators.

7. A coaxial filter as claimed in claim 6, wherein the diameter of said annular metallic member is smaller than the outer diameter of said metallic cylinder.

8. A coaxial filter arrangement comprising:

(a) a plurality of resonators each having:

a center conductor;

a metallic cylinder having a bottom and a peripheral wall portion with a predetermined diameter, said metallic wall portion being attached to one end of said center conductor in such a manner that said peripheral wall portion surrounds said center conductor; and an outer conductor having a closed end and an open end, said closed end being connected to the other end of said center conductor so that said outer conductor is coaxially arranged with said center conductor, the axial length of said outer conductor being shorter than that of said center conductor so that said peripheral wall portion of said metallic cylinder is received in the bore of said outer conductor;

means for positioning said metallic cylinder in said bore with a maximum diameter portion of said peripheral wall portion being received entirely in said bore; and (b) a dielectric plate having coupling capacitances for coupling said plurality of resonators to form said filter, said dielectric plate being positioned apart from the open end of each of said outer conductors by a predetermined distance.

9. A coaxial filter as claimed in claim 8, wherein said means includes a convex portion of the bottom of said metallic cylinder whereby the center of said bottom projects outwardly from said bore.

10. A coaxial filter as claimed in claim 8, wherein said means comprises an annular metallic member interposed between said dielectric plate and the outer surface of said bottom of said metallic cylinder of each of said resonators.

11. A coaxial filter as claimed in claim 10, wherein the predetermined diameter of said annular metallic member is smaller than the outer diameter of said metallic cylinder.

12. A coaxial filter arrangement comprising:

(a) a plurality of resonators each having:

a center conductor;

a metallic cylinder having a bottom and a peripheral wall portion with a predetermined, non-uniform diameter, said metallic wall portion being attached to one end of said center conductor in such a manner that said peripheral wall portion surrounds said center conductor; and an outer conductor having a closed end and an open end, said closed end being connected to the other end of said center conductor so that said outer conductor is coaxially arranged with said center conductor, the axial length of said outer conductor being shorter than that of said center conductor so that said metallic cylinder is received in the bore of said outer conductor with a maximum diameter portion of said peripheral wall portion being received entirely in said bore; and (b) a dielectric plate having coupling capacitances for coupling said plurality of resonators to form said filter, said dielectric plate being positioned apart from the open end of each of said outer conductors by a predetermined distance.

* * * * *